US012043812B2

(12) United States Patent
Kim et al.

(10) Patent No.: US 12,043,812 B2
(45) Date of Patent: Jul. 23, 2024

(54) LUBRICATING COMPOSITION FOR INHIBITING PLUGGING AND METHOD OF INHIBITING PLUGGING USING THE SAME

(71) Applicants: SK Innovation Co., Ltd., Seoul (KR); SK Geo Centric Co., Ltd., Seoul (KR)

(72) Inventors: Sun Joo Kim, Daejeon (KR); Mi So Kim, Daejeon (KR); Ho Seong Lee, Daejeon (KR); Min Gu Kim, Daejeon (KR); Jae Hyun Park, Daejeon (KR)

(73) Assignees: SK Innovation Co., Ltd., Seoul (KR); SK Geo Centric Co., Ltd., Seoul (KR)

( * ) Notice: Subject to any disclaimer, the term of this patent is extended or adjusted under 35 U.S.C. 154(b) by 0 days.

(21) Appl. No.: 17/543,801

(22) Filed: Dec. 7, 2021

(65) Prior Publication Data

US 2022/0177803 A1 Jun. 9, 2022

(30) Foreign Application Priority Data

Dec. 8, 2020 (KR) ..... 10-2020-0170190

(51) Int. Cl.
*C10M 129/40* (2006.01)
*C10M 149/18* (2006.01)
(Continued)

(52) U.S. Cl.
CPC ..... *C10M 129/40* (2013.01); *C10M 149/18* (2013.01); *C10M 149/22* (2013.01);
(Continued)

(58) Field of Classification Search
CPC .. C10M 2203/1006; C10M 2203/1025; C10M 2205/02; C10M 2207/123; C10M 2207/401; C10M 2209/084; C10M 105/08; C10M 105/22; C10M 107/20; C10M 107/26; C10N 2030/06; C10N 2030/24
See application file for complete search history.

(56) References Cited

U.S. PATENT DOCUMENTS 4,721,761 A 1/1988 Omae et al.
4,761,241 A * 8/1988 Kobori ..... C10M 107/28 508/474
(Continued)

FOREIGN PATENT DOCUMENTS

EP 0694603 A1 1/1996
EP 0888391 B1 4/2001
(Continued)

OTHER PUBLICATIONS

"Antifoulant Chemical Treatment", https//www.watertechnologies.com/, 2 pages.

*Primary Examiner* — Vishal V Vasisth
(74) *Attorney, Agent, or Firm* — The Webb Law Firm

(57) ABSTRACT

Provided is a lubricating composition for inhibiting plugging including a base oil and any one selected from a fatty acid and an emulsifier, with the lubricating composition forming a single phase even when a carboxylic acid-based monomer is introduced with respect to the base oil. The lubricating composition suppresses plugging occurring in a process of preparing a copolymer derived from the carboxylic acid-based monomer. In addition, also provided is a method of inhibiting plugging using the lubricating composition for inhibiting plugging.

9 Claims, 1 Drawing Sheet

(51) Int. Cl.
*C10M 149/22* (2006.01)
*C10M 169/04* (2006.01)

(52) U.S. Cl.
CPC .... *C10M 169/04* (2013.01); *C10M 2207/125* (2013.01); *C10M 2217/044* (2013.01); *C10M 2217/046* (2013.01)

(56) References Cited

U.S. PATENT DOCUMENTS 5,422,022 A * 6/1995 Chamberlin, III ... C10M 167/00 508/435
5,578,557 A 11/1996 Dougan et al.
2007/0284108 A1* 12/2007 Roes ..... C22C 38/28 166/302
2014/0179571 A1 6/2014 Loper et al.
2015/0111798 A1 4/2015 Li et al.
2015/0152053 A1 6/2015 Tong
2016/0186084 A1* 6/2016 Schilowitz ..... C10M 129/00 508/370
2017/0260474 A1* 9/2017 Gutermuth ..... C08F 210/02
2018/0134824 A1 5/2018 Eddy et al.
2019/0218472 A1 7/2019 Yeung et al.
2022/0242981 A1 8/2022 Aoki et al.

FOREIGN PATENT DOCUMENTS

EP 0888391 B1 7/2001
EP 0888391 B1 7/2011
EP 3763779 A1 1/2021
KR 19930002901 B1 4/1993
KR 1020140081747 A 7/2014
KR 1020160074556 A 6/2016
KR 1020160093679 A 8/2016
KR 1020190086374 A 7/2019
WO 2013093080 A1 6/2013
WO 2018063853 A1 4/2018
WO 2020262482 A1 12/2020
WO 20200262482 A1 12/2020

* cited by examiner

LUBRICATING COMPOSITION FOR INHIBITING PLUGGING AND METHOD OF INHIBITING PLUGGING USING THE SAME

CROSS-REFERENCE TO RELATED APPLICATION

This application claims priority to Korean Patent Application No. 10-2020-0170190, filed Dec. 8, 2020, the disclosure of which is hereby incorporated by reference in its entirety.

BACKGROUND OF THE INVENTION

Field of the Invention

The following disclosure relates to a lubricating composition for inhibiting plugging and a method of inhibiting plugging using the same.

Description of Related Art

An ethylene-carboxylic acid copolymer such as an ethylene-acrylic acid copolymer is used in various applications such as a sealing material, an adhesive material, a packing material, and an optical film, and is widely practiced industrially.

The ethylene-carboxylic acid copolymer may be prepared by polymerizing ethylene with a carboxylic acid-based compound such as an acrylic acid and a methacrylic acid as a comonomer by a continuous reactor, and since the carboxylic acid-based compound has higher self-polymerization reactivity than ethylene, the carboxylic acid-based compound may be self-polymerized when exposed to high temperatures in a process of being supplied by a flow path, a pump, a compressor, and the like.

In this case, equipment defects such as clogging and flow path blocking of the above-described equipment such as a pump, a compressor, and a path flow may be caused, and thus, a production yield of the copolymer is lowered so that it is difficult to uniformly, continuously, and repeatedly proceed with the process, and a risk of accidents is increased so that the safety of workers is problematic.

Methods of using additives for inhibiting self-polymerization between carboxylic acid-based monomers having high self-polymerization reactivity together are being studied, but there is still a problem of equipment defects such as clogging and fouling of the equipment described above due to leakage of the monomers.

Therefore, development of a lubricating composition for inhibiting plugging which may improve a work yield and further improve work stability by directly blocking equipment defects by leakage of the carboxylic acid-based monomers having high-polymerization reactivity described above is currently needed.

RELATED ART DOCUMENTS

Patent Documents (Patent Document 0001) Korean Patent Laid-Open Publication No. 10-2016-0093679 (Aug. 8, 2016)

SUMMARY OF THE INVENTION

An embodiment of the present invention is directed to providing a lubricating composition for inhibiting plugging which may suppress equipment defects such as fouling and clogging by self-polymerization of monomers, by increasing a friction coefficient due to leakage of a carboxylic acid-based monomer in the lubricating composition.

Another embodiment of the present invention is directed to providing a lubricating composition for inhibiting plugging which may block the equipment defects described above to further improve a process yield and work stability.

In one general aspect, a lubricating composition for inhibiting plugging includes: a base oil and any one selected from a fatty acid and an emulsifier, wherein the lubricating composition forms a single phase when a carboxylic acid-based monomer is introduced with respect to the base oil.

In the lubricating composition for inhibiting plugging according to an exemplary embodiment of the present invention, the fatty acid may be a C15 to C30 unsaturated fatty acid.

In the lubricating composition for inhibiting plugging according to an exemplary embodiment of the present invention, the fatty acid may be included at 2 to 20 wt %, with respect to the total lubricating composition.

In the lubricating composition for inhibiting plugging according to an exemplary embodiment of the present invention, the emulsifier may be included at 0.1 to 15 wt %, with respect to the total lubricating composition.

In the lubricating composition for inhibiting plugging according to an exemplary embodiment of the present invention, the lubricating composition for inhibiting plugging may include both the fatty acid and the emulsifier.

In the lubricating composition for inhibiting plugging according to an exemplary embodiment of the present invention, the lubricating composition for inhibiting plugging may be a single phase at a temperature in a range of 40 to 85° C.

In the lubricating composition for inhibiting plugging according to an exemplary embodiment of the present invention, the carboxylic acid-based monomer introduced to the lubricating composition for inhibiting plugging may be included at 0.1 to 50 wt %.

In the lubricating composition for inhibiting plugging according to an exemplary embodiment of the present invention, the lubricating composition for inhibiting plugging may have a drive friction coefficient at the time of introducing the carboxylic acid-based monomer of less than 0.3.

In the lubricating composition for inhibiting plugging according to an exemplary embodiment of the present invention, the lubricating composition for inhibiting plugging may inhibit plugging of a discharge part at 30 N or more at 55° C.

In another general aspect, a method of inhibiting plugging includes: in a process of preparing a copolymer derived from a carboxylic acid-based monomer, injecting the lubricating composition described above to a discharge part which discharges the carboxylic acid-based monomer and inhibiting self-polymerization of the carboxylic acid-based monomer.

In the method of inhibiting plugging according to the present invention, an injection rate of the lubricating composition for inhibiting plugging to the discharge part may be 2 kg/hr to 50 kg/hr.

In the method of inhibiting plugging according to the present invention, a temperature in the discharge part may be 20 to 85° C. and a discharge pressure from the discharge part may be 1,000 to 3,000 bar.

Other features and aspects will be apparent from the following detailed description, the drawings, and the claims.

DESCRIPTION OF THE INVENTION

Figure 1A:
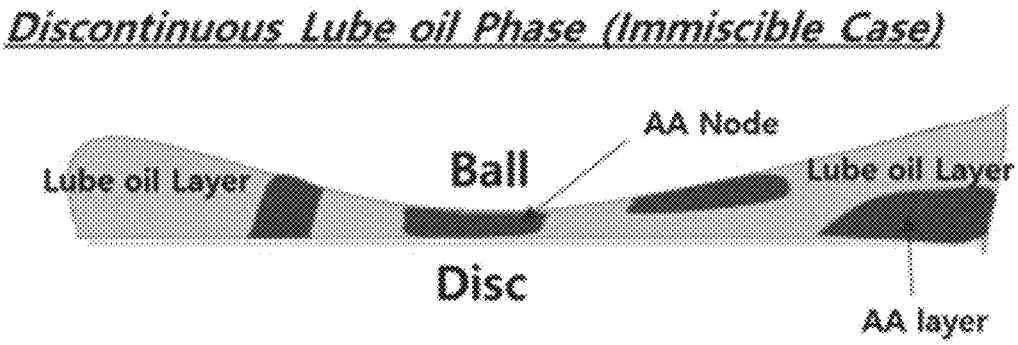
FIGS. 1A and 1B are a schematic diagram showing a plugging inhibition principle of a lubricating composition according to an exemplary embodiment of the present invention.

Hereinafter, the present invention will be described in more detail with reference to specific examples and exemplary embodiments including the accompanying drawings. However, the following specific examples or exemplary embodiments are only a reference for describing the present invention in detail, and the present invention is not limited thereto, and may be implemented in various forms.

In addition, unless otherwise defined, all technical terms and scientific terms have the same meanings as those commonly understood by one of those skilled in the art to which the present invention pertains. The terms used herein are only for effectively describing a certain specific example, and are not intended to limit the present invention.

In addition, the singular form used in the specification and claims appended thereto may be intended to also include a plural form, unless otherwise indicated in the context.

In addition, unless particularly described to the contrary, "comprising" any elements will be understood to imply further inclusion of other elements rather than the exclusion of any other elements.

The term "(meth)acrylic acid" used in the present invention is a term encompassing both "methacrylic acid" and "acrylic acid".

The present invention for achieving the above objects provides a lubricating composition for inhibiting plugging and a method of inhibiting plugging using the same.

The present inventors intensively studied a lubricating composition which inhibits plugging or fouling by monomers leaking out on a lubricating oil in a high-pressure pump into which the monomers are injected to inhibit equipment defects such as high-pressure pump blockage, in a process of preparing a copolymer derived from a carboxylic acid-based monomer. Accordingly, the inventors confirmed that by preparing a lubricating composition including a base oil and any one selected from a fatty acid or an emulsifier, a single phase may be formed and a friction coefficient may be reduced to implement the effects described above, even in the case in which a carboxylic acid-based monomer is leaked from a discharge part and introduced during the process, thereby completing the present invention.

Hereinafter, the lubricating composition for inhibiting plugging according to the present invention will be described in detail.

The lubricating composition for inhibiting plugging according to the present invention includes a base oil and any one selected from a fatty acid and an emulsifier, wherein a single phase is maintained for the lubricating composition when a carboxylic acid-based monomer is introduced to the lubricating composition with respect to the base oil.

The base oil may be included as a base solvent, a diluent, or a medium of the lubricating composition. The kind of base oil is not particularly limited and a lubricating oil used in polymerization equipment, petrochemical equipment, and the like may be used, and as an example, any one selected from the group consisting of mineral oil, polyalphaolefin (PAO), alkyl benzene, alkyl naphthalene, polyvinylether, polyalkyleneglycol, polycarbonate, polyol ester, ethylenealphaolefin copolymer, polybutene, polyethylene glycol, aromatic ester, hindered ester, dibasic ester, paraffin-based mineral oil, naphthene-based mineral oil, or a mixture thereof may be used.

As the fatty acid, C15 to C30 unsaturated fatty acids may be used, and as a specific example, any one or a mixture of two or more selected from myristoleic acid, palmitoleic acid, oleic acid, linoleic acid, eicosapentaenoic acid (EPA), docosahexaenoic acid (DHA), and the like may be used, but the present invention is not limited thereto.

The lubricating composition according to a preferred exemplary embodiment may include the base oil and the fatty acid, in which the fatty acid may be included at 2 to 20 wt %, specifically 3 to 15 wt %, and more specifically 5 to 10 wt %, with respect to the total lubricating composition. Within the content range, even in the case in which a carboxylic acid-based monomer is introduced to the lubricating composition, phase separation does not occur, the composition has excellent miscibility of a single phase, and an increase in a friction coefficient due to introduction of the carboxylic acid-based monomer is reduced, thereby inhibiting accumulation of the carboxylic acid-based monomer leaking in a specific area and self-polymerization of the carboxylic acid-based monomer under high temperature and high pressure conditions to prevent plugging, which is thus preferred.

The emulsifier may be a non-ionic surfactant, an anionic surfactant, or a cationic surfactant, and a known emulsifier may be used without limitation, but preferably, a polymer type surfactant may be used, and specifically, one or a mixture of two or more selected from cationic polymers having a polyethyleneimine group and a phosphonate group, and polyolefin-based polymers having a polyisobutylene succinimide (PIBSI) group may be used. As the cationic polymer having a polyethyleneimine group and a phosphonate group, Thermoflo 7049 available from Suez may be preferably used, and as the polyolefin-based polymer having a polyisobutylene succinimide group, Prochem 3F18 available from Suez may be preferably used.

The lubricating composition according to a preferred exemplary embodiment may include a base oil and an emulsifier, wherein the emulsifier may be included at 0.1 to 15 wt %, specifically at 1 to 15 wt %, with respect to the total lubricating composition. Within the content range, when 0.1 to 50 wt %, specifically 0.1 to 30 wt %, of the carboxylic acid-based monomer is introduced with respect to the base oil, phase separation does not occur, a single phase of emulsion is formed to have excellent miscibility, and an increase in a friction coefficient due to introduction of the carboxylic acid-based monomer is reduced, thereby inhibiting accumulation of the carboxylic acid-based monomer leaking in a specific area and self-polymerization of the carboxylic acid-based monomer under high temperature and high pressure conditions to prevent plugging, which is thus preferred.

As a non-limiting exemplary embodiment, the lubricating composition for inhibiting plugging may include both the fatty acid and the emulsifier, in which the fatty acid may be included at 1 to 15 wt % and the emulsifier may be included at 0.1 to 15 wt %, with respect to the total lubricating composition. Within the content range, when 1 to 30 wt % of the carboxylic acid-based monomer is introduced with respect to the base oil, phase separation does not occur, a single phase of emulsion is formed to have excellent miscibility, and accumulation of the carboxylic acid-based monomer leaking in a specific area is prevented to inhibit self-polymerization of the carboxylic acid-based monomer under high temperature and high pressure conditions to prevent plugging, which is thus preferred.

The lubricating composition for inhibiting plugging according to an exemplary embodiment of the present invention may have a single phase in a temperature range of 20 to 85° C., specifically at a temperature of 50° C. or higher, more specifically at a temperature of 70° C. or higher, and still more specifically at a temperature of 75° C. or higher. Here, the single phase may refer to having uniform one phase without separation into two or more phases.

Figure 1B:
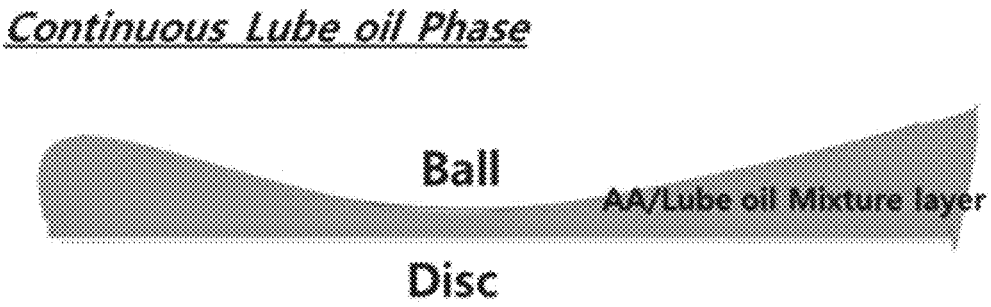

More specifically, in the case of a conventional lubricating composition, as shown in FIG. 1A, when an acrylic acid monomer leaks to cause phase separation, a polyacrylic acid (PAA) formed by self-polymerization of the acrylic acid monomer by friction energy occurs to cause plugging, fouling, and the like; however, the lubricating composition according to an exemplary embodiment of the present invention forms a continuous single phase without phase separation even in the case in which the acrylic acid monomer leaks as shown in FIG. 1B, thereby inhibiting production and accumulation of the polyacrylic acid (PAA) in a specific area in the equipment during the process under high temperature and high pressure conditions to inhibit occurrence of plugging, fouling, and the like, which is thus preferred.

The content of the carboxylic acid-based monomer leaking in the present invention may refer to a content leaking during the process, specifically, for example, may be more than 0 wt %, or 0.01 to 30 wt %, but is not limited thereto. The lubricating composition for inhibiting plugging according to an exemplary embodiment may have a friction coefficient at the time of introduction of a carboxylic acid-based monomer of less than 0.36, specifically less than 0.3, more specifically less than 0.28, and still more specifically less than 0.25, but the present invention is not limited thereto.

The lubricating composition for inhibiting plugging according to an exemplary embodiment of the present invention may have a drive friction coefficient measured under the conditions of a ground contact load between ball/disk of 30 N at 55° C. (MTM TEST) of less than 0.4, and a drive friction coefficient measured under the conditions of a ground contact load between ball/disk of 60 N at 55° C. (MTM TEST) of less than 0.3, specifically 0.28 or less, and more specifically less than 0.26.

The lubricating composition for inhibiting plugging according to an exemplary embodiment of the present invention may inhibit plugging in a discharge part at a ground contact load of 30 N or more at 55° C., in which the discharge part may refer to a discharge part described later.

The lubricating composition for inhibiting plugging according to the present invention has an effect of inhibiting occurrence of a problem such as blockage, plugging, and fouling by accelerating self-polymerization by friction of a friction coefficient of 0.3 or more occurring in a piston or a packing part of a pump when a carboxylic acid-based monomer leaking in a high-pressure pump, cylinder, and the like is present as a separated phase without being mixed with a lubricating oil phase in a discharge part, in the process of preparing a copolymer derived from a carboxylic acid-based monomer.

Accordingly, the present invention also provides a plugging inhibitor including a base oil and any one or two selected from a fatty acid and an emulsifier.

Hereinafter, a method of inhibiting plugging using the lubricating composition for inhibiting plugging according to the present invention will be described.

The method of inhibiting plugging according to an exemplary embodiment of the present invention includes: in a process of preparing a copolymer derived from a carboxylic acid-based monomer, injecting the lubricating composition described above to a discharge part which discharges the carboxylic acid-based monomer and suppressing self-polymerization of the carboxylic acid-based monomer.

The copolymer derived from the carboxylic acid-based monomer may refer to, specifically, a copolymer derived from an olefin and a carboxylic acid-based monomer, and the olefin monomer may be any one or two or more selected from ethylene, propylene, butylene, and the like, but is not limited thereto.

The carboxylic acid-based monomer may include an unsaturated carboxylic acid capable of a chain polymerization reaction, and as a specific example, may be any one or two or more selected from (meth)acrylic acid, esters thereof, and the like. In particular, preferably, the copolymer may be an ethylene-acrylic acid copolymer, and the lubricating composition for inhibiting plugging of the present invention may be preferably applied in the process of preparing an ethylene-acrylic acid copolymer, but the present invention is not limited thereto.

The discharge part in the process of preparing a copolymer derived from a carboxylic acid-based monomer may include a piston and a packing part, and the carboxylic acid-based monomer supplied through a discharge flow path may be pumped or ejected by reciprocating motion inside the packing part of the piston. The packing part may be a sealing member such as, for example, bushing and cylinder. When the carboxylic acid-based monomer leaks into a gap between a piston of a packing part and a packing part, and the like, the carboxylic acid-based monomer may locally accumulate and friction of a piston and a packing part repeatedly occurs in the gap, and thus, the carboxylic acid-based monomer is self-polymerized to form a self-polymer such as polyacrylic acid (PAA) to cause fouling, plugging, and the like.

The lubricating composition for inhibiting plugging according to an exemplary embodiment of the present invention is injected to the discharge part described above, thereby having excellent miscibility even when the carboxylic acid-based monomer leaks, to form a single phase, so that local concentration improvement and self-polymerization of the carboxylic acid-based monomer are inhibited to inhibit plugging, fouling, and the like.

Here, the injection rate of the lubricating composition for inhibiting plugging to the discharge part may be 2 to 50 kg/hr, a temperature of the discharge part may be 20 to 85° C., and a discharge pressure from the discharge part may be 1,000 to 3,000 bar, but are not limited thereto.

The lubricating composition for inhibiting plugging according to the present invention suppresses a polymerization reaction which is unnecessary or not derived in the process of forming a copolymer derived from a carboxylic acid-based monomer, thereby suppressing occurrence of clogging, flow path blockage, fouling, plugging, and the like of the equipment described above such as a pump, compressor, and a flow path to decrease equipment defects and to increase production process efficiency.

Hereinafter, the present invention will be described in more detail with reference to the Examples and Comparative Examples. However, the following examples and comparative examples are only an example for describing the present invention in more detail, and do not limit the present invention in any way.

[Experimental Method]

1. Mini-Traction Machine (MTM) Test

Figure 2:
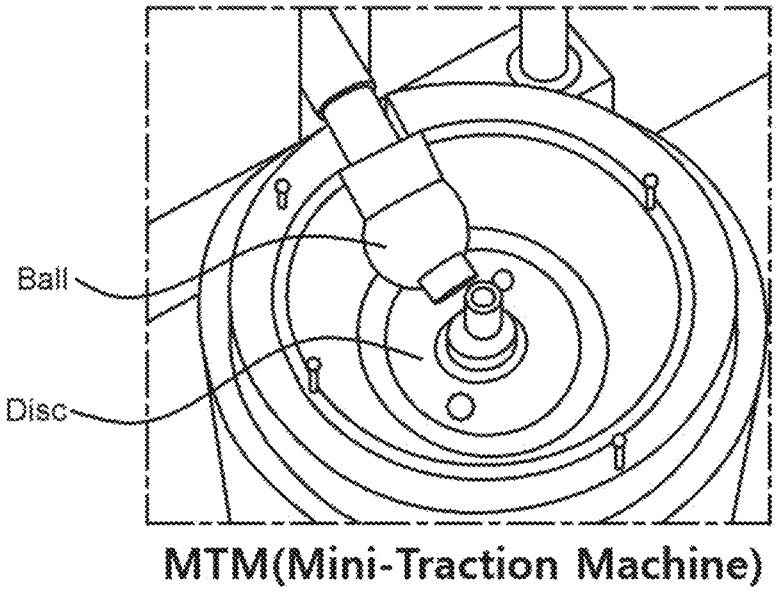
FIG. 2 is a real image of a disk and a ball of friction measurement equipment.

An acrylic acid (AA) (purity of 99%, manufactured by Sigma Aldrich) was mixed for a manufactured lubricating composition to prepare a sample solution. At this time, a polymerization inhibitor which was previously contained in the acrylic acid was removed by distillation to exclude a possibility of self-polymerization inhibition factor by the polymerization inhibitor. Presence of a self-polymer in the prepared sample solution was observed using friction measurement equipment (mini-traction machine (MTM) 2) as shown in FIG. 2 while rotating a disc and a ball. The sample solution was supplied into the disc through an inlet together with the ball at an initial temperature of 55° C., and then the disc and the ball were brought into contact with the sample solution while rotating the disc and the ball together. While a load between the disc and the ball and a slide roll ratio (SRR) between the ball and the disc were changed, it was observed whether the self-polymer was produced.

Example 1

67.9 g of HYPERCOMP-1000 (manufactured by SK Innovation) as a base oil was mixed with 2.1 g of an oleic acid at room temperature for 30 minutes or more in a 100 ml container using a magnetic bar to prepare a lubricating composition having an oleic acid content of 3 wt %.

Example 2

A lubricating composition was prepared in the same manner as in Example 1, except that 63.7 g of the base oil was mixed with 6.3 g of the oleic acid so that the oleic acid content was 9 wt %.

Example 3

68.32 g of HYPERCOMP-1000 (manufactured by SK Innovation) as a base oil was mixed with 1.68 g of an emulsifier (Thermoflo 7049 available from Suez) at room temperature for 30 minutes or more in a 100 ml container using a magnetic bar to prepare a lubricating composition having an emulsifier content of 2.4 wt %.

Example 4

A lubricating composition was prepared in the same manner as in Example 3, except that 64.82 g of the base oil was mixed with 5.18 g of the emulsifier (Thermoflo 7049 available from Suez) so that the emulsifier content was 7.4 wt %.

Example 5

67.2 g of HYPERCOMP-1000 (manufactured by SK Innovation) as a base oil was mixed with 2.1 g of an oleic acid and 0.7 g of an emulsifier (Thermoflo 7049 available from Suez) at room temperature for 30 minutes or more in a 100 ml container using a magnetic bar to prepare a lubricating composition having an oleic acid content of 3 wt % and an emulsifier content of 1 wt %.

Comparative Example 1

HYPERCOMP-1000 (manufactured by SK Innovation) was used alone as a base oil.

The lubricating compositions prepared in Examples 1 to 5 and Comparative Example 1 were used to evaluate the properties as follows.

[Experimental Example 1] Phase Separation Aspect Depending on Temperature of Lubricating Composition and Content of Acrylic Acid The lubricating compositions prepared in Examples 1 to 5 were mixed with 30 g of an acrylic acid and a phase separation aspect is shown in the following Table 1.

In addition, compositions in which the lubricating compositions prepared in Examples 1 and 2 were mixed with 17.5 g of an acrylic acid were set as Examples 6 and 7, respectively, and a phase separation aspect is shown in the following Table 1 together.

TABLE 1

| | Composition of lubricating composition (unit: g) | | | | Acrylic acid | Phase separation aspect | | |
|---|---|---|---|---|---|---|---|---|
| | Description | Base oil | Oleic acid | emulsifier | (unit: g) | 25° C. | 60° C. | 70° C. |
| Example 1 | Oleic acid 3% | 67.9 | 2.1 | 0 | 30 | Phase separated | Phase separated | Phase separated |
| Example 2 | Oleic acid 9% | 63.7 | 6.3 | 0 | 30 | Phase separated | Single phase | Single phase |
| Example 3 | Emulsifier 2.5% | 68.32 | 0 | 1.68 | 30 | Single phase | Single phase | Single phase |
| Example 4 | Emulsifier 7.4% | 64.82 | 0 | 5.18 | 30 | Single phase | Single phase | Single phase |
| Example 5 | Oleic acid 3% + emulsifier 1% | 67.2 | 2.1 | 0.7 | 30 | Single phase | Single phase | Single phase |
| Example 6 | Oleic acid 3% | 67.9 | 2.1 | 0 | 17.5 | Phase separated | Phase separated | Phase separated |
| Example 7 | Oleic acid 9% | 63.7 | 6.3 | 0 | 17.5 | Phase separated | Single phase | Single phase |
| Comparative Example 1 | x | 70 | 0 | 0 | 30 | Phase separated | Phase separated | Phase separated |

[Experimental Example 2] MTM Test Evaluation of Lubricating Composition

As shown in the following Table 2, the lubricating compositions of Examples 1 to 7 and Comparative Example 1 including an acrylic acid were evaluated by the MTM test, and the results are shown in Table 2.

Here, a base oil Hypercomp1000 (manufactured by SK Innovation) without being mixed with an acrylic acid was used as a control group.

TABLE 2

| | Drive friction coefficient (by MTM test) | | | | |
|---|---|---|---|---|---|
| | 55° C., 30 N | 55° C., 50 N | 55° C., 60 N | 55° C., 70 N | 55° C., 75 N |
| Example 1 | 0.36 | 0.3/PAA produced | | Unable to test | |
| Example 2 | 0.31 | 0.28 | 0.28 | 0.24/PAA produced | Unable to test |
| Example 3 | 0.31 | 0.19 | 0.21 | 0.23 | 0.21 |
| Example 4 | 0.31 | 0.27 | 0.26 | 0.22 | 0.18 |
| Example 5 | 0.30 | 0.27 | 0.26 | 0.26/PAA produced | Unable to test |
| Example 6 | 0.29 | 0.26 | 0.25 | 0.25 | 0.24/PAA produced |
| Example 7 | 0.22 | 0.13 | 0.12 | 0.12 | 0.11 |
| Comparative Example 1 | 0.38 | 0.36/PAA produced | | Unable to test | |
| Control group | 0.1 | 0.1 | 0.1 | 0.1 | 0.1 |

As shown in Table 1, it was found that the control group which did not include an acrylic acid and used a base oil alone maintained a friction coefficient of 0.1, but when the acrylic acid was included, the friction coefficient was increased. Here, it was found that in the examples including the oleic acid and/or the emulsifier, the friction coefficient was low as compared with Comparative Example 1, and in particular, a decrease in the friction coefficient was larger under harsh conditions of a greater load at the same temperature. Moreover, it was found that Examples 6 and 7 having a lower acrylic acid content had a lower friction coefficient as compared with Examples 1 to 5 having a higher acrylic acid content. This means that though an acrylic acid was introduced into the lubricating composition, a rapid increase in a friction coefficient was suppressed, thereby suppressing occurrence of plugging by self-polymerization of the acrylic acid in a specific area. In addition, when the content of the acrylic acid introduced was low, the friction coefficient was decreased and miscibility was sufficiently stable, and thus, lubricating performance was improved to the level of the control group and occurrence of PAA was able to be further suppressed.

More specifically, as shown in Tables 1 and 2, when the acrylic acid and the base oil had excellent miscibility as a single phase, it was confirmed that production of a polyacrylic acid (PAA) which is a self-polymer of the acrylic acid to cause plugging under the conditions of 30 N or more at 55° C. was suppressed and delayed. In addition, when a single phase of an emulsion phase was formed by the emulsifier as shown in Examples 3 and 4 also, it was confirmed that polyacrylic acid (PAA) was less produced.

Furthermore, as shown in Table 2, in Example 3 including the base oil with a sufficient oleic acid, it was confirmed that excellent lubrication was possible without production of PAA even under the harsh conditions up to 60 N, and in Examples 4 and 5 including the emulsifier, it was confirmed that excellent lubrication was possible without production of PAA under the harsh conditions up to 75 N. In contrast, in Comparative Example 1 using a base oil alone, it was confirmed that PAA was easily produced and plugging occurred when an acrylic acid was included, and thus, measurement was not possible in the MTM test.

The lubricating composition for inhibiting plugging according to the present invention inhibits an increase in a friction coefficient due to leakage of a carboxylic acid-based monomer in the lubricating composition and improves miscibility to implement an effect as an excellent lubricating composition, and also, reduces a friction coefficient and inhibits acceleration of self-polymerization by the leakage of the carboxylic acid-based monomer and the increase in friction in a specific area to inhibit and delay the self-polymerization of the carboxylic acid-based monomer, thereby significantly inhibiting occurrence of plugging, fouling, and the like.

In addition, the lubricating composition for inhibiting plugging according to the present invention is applied to a process of forming a copolymer derived from a carboxylic acid-based monomer to inhibit a polymerization reaction of the carboxylic acid-based monomer which is unnecessary or not derived by leakage of the carboxylic acid-based monomer in the lubricating composition, thereby inhibiting occurrence of clogging, flow path blockage, fouling, plugging, and the like of the equipment described above such as a pump, a compressor, and a flow path to decrease equipment defects and increase production process efficiency.

Hereinabove, although the present invention has been described by specific matters, limited exemplary embodiments, and drawings, they have been provided only for assisting the entire understanding of the present invention, and the present invention is not limited to the exemplary embodiments, and various modifications and changes may be made by those skilled in the art to which the present invention pertains from the description.

Therefore, the spirit of the present invention should not be limited to the above-described exemplary embodiments, and the following claims as well as all modified equally or equivalently to the claims are intended to fall within the scope and spirit of the invention.

What is claimed is:

1. A lubricating composition for inhibiting plugging of equipment in the polymerization of ethylene with an unsaturated carboxylic acid monomer capable of a chain polymerization reaction, comprising:

a base oil; and an emulsifier selected from the group consisting of a cationic polymer having a polyethyleneimine group and a phosphonate group; and a polyolefin-based polymer having a polyisobutylene succinimide (PIBSI) group, wherein the lubricating composition forms a single phase in a temperature range of 20 to 85° C. and suppresses self-polymerization of the unsaturated carboxylic acid monomer when the unsaturated carboxylic acid monomer is introduced with respect to the base oil, wherein the emulsifier is included at 1 to 15 wt %, with respect to the total lubricating composition, and wherein the unsaturated carboxylic acid monomer is selected from the group consisting of an acrylic acid monomer and a methacrylic acid monomer.

2. The lubricating composition for inhibiting plugging of claim 1, wherein the lubricating composition for inhibiting plugging further comprises a C15 to C30 unsaturated fatty acid and the emulsifier.

3. The lubricating composition for inhibiting plugging of claim 1, wherein the lubricating composition for inhibiting plugging forms a single phase at a temperature in a range of 40 to 85° C.

4. The lubricating composition for inhibiting plugging of claim 1, wherein the unsaturated carboxylic acid monomer introduced to the lubricating composition for inhibiting plugging is comprised at 0.1 to 50 wt %.

5. The lubricating composition for inhibiting plugging of claim 1, wherein the lubricating composition for inhibiting plugging has a drive friction coefficient at the time of introducing the unsaturated carboxylic acid monomer of less than 0.3.

6. The lubricating composition for inhibiting plugging of claim 1, wherein the lubricating composition for inhibiting plugging suppresses plugging in a discharge part at 30 N or more at 55° C.

7. A method of inhibiting plugging in a process of preparing a copolymer derived from an unsaturated carboxylic acid monomer capable of a chain polymerization reaction, the method comprising:

injecting the lubricating composition of claim 1 to a discharge part which discharges the unsaturated carboxylic acid monomer and suppressing self-polymerization of the unsaturated carboxylic acid monomer.

8. The method of inhibiting plugging of claim 7, wherein an injection rate of the lubricating composition for inhibiting plugging to the discharge part is 2 kg/hr to 50 kg/hr.

9. The method of inhibiting plugging of claim 8, wherein a temperature in the discharge part is 20 to 85° C. and a discharge pressure from the discharge part is 1,000 to 3,000 bar.

* * * * *